US006047417A

United States Patent [19]

Derakhshan

[11] Patent Number: 6,047,417

[45] Date of Patent: Apr. 11, 2000

[54] CABINET DOOR OPERATED FAUCET VALVE

[76] Inventor: Soheyl Derakhshan, 5355 Pacifica Dr., San Diego, Calif. 92109

[21] Appl. No.: 09/166,667

[22] Filed: Oct. 5, 1998

[51] Int. Cl.[7] ..... E03C 1/04

[52] U.S. Cl. ..... 4/677; 4/675; 137/599; 137/884; 251/295

[58] Field of Search ..... 4/675–678, 623, 4/624, 626, 630, 638; 137/599, 884, 337; 138/31; 251/295, 129.04

[56] References Cited

U.S. PATENT DOCUMENTS 4,757,943 7/1988 Sperling et al. ..... 137/599
4,942,896 7/1990 Slusser ..... 4/192
5,322,086 6/1994 Sullivan ..... 137/599
5,385,172 1/1995 Perrott et al. ..... 138/31
5,386,600 2/1995 Gilbert, Sr. ..... 4/677

*Primary Examiner*—Henry J. Recla
*Assistant Examiner*—Tuan Nguyen
*Attorney, Agent, or Firm*—Lyon & Lyon LLP

[57] ABSTRACT

A block containing a set of solenoid valves interposed between a water supply line and an existing faucet and activated by switches mounted on the sink cabinet door frame will provide instantaneous or continuous control of water flow from an existing sink faucet. The controlling switches for these solenoid valves are easily mounted on the cabinet door frame or in the form of padded pressure sensitive switches mounted directly on the surface of the cabinet doors. Slight knee pressure on the door or padded switches instantly opens the solenoid valves to activate water flow.

2 Claims, 4 Drawing Sheets

13
11
12
14
17
25
23
24
30
32
30
32
33
26
28
28
11
17
27
34
11
36
35
36
12
27

1
10
4
5
37
37

19
20
18
21
22

CABINET DOOR OPERATED FAUCET VALVE

BACKGROUND OF THE INVENTION

1. Field of the Invention

The present invention relates generally to sink faucets and, more specifically, to an automatic valve control system for remotely activating a water faucet.

2. Description of the Prior Art

Remote and automatic control of a sink faucet go back many years. In early years, the use of photo cells and foot pedals were common, and, more recently, the use of electronic proximity switches has become widespread. The introduction of numerous electronic controlled faucets in recent years points to the need of a functional multipurpose remote and automatic sink faucet control system. Besides the protection from transfer of bacteria and the convenience of hand free operations, the water saving potential and capability of a reliable, low maintenance, functional system will make such a device a necessity rather than a luxury.

Unfortunately, the electronic and foot pedal versions of faucet control valves have demonstrated many limitations and short falls, making the need for a more practical and user friendly device for households even more apparent. The existing electronic version of the faucet control valve limits its use for simple hand washing application. Its indiscriminate actuation by sensing an object makes this type of valve faucet useless for any other application that requires instantaneous on/off control of water flow. The uncontrolled and indiscriminate actuation by proximity or motion sensing devices make simple tasks such as dishwashing, clothes washing, or even sink washing a self defeating act. Other disadvantages of electronic faucets are the lack of control over the water flow and ability to override the system. In case of power failure, these units can only rely on limited storage capacity of the battery cells.

Furthermore, because the components of the electronic faucets are interdependent and inseparable, they replace the existing faucet without making any use of it. Also, because of extensive electronic circuitry and its related high cost, plus their functional limitations, the electronic faucets are most suitable only for newly built public hand washing facilities where high cost and limitations are not of any major concern.

Similarly, the floor mounted foot pedal is an obtrusive device, difficult to use and to install and requires extensive plumbing changes. The foot pedals bulky space-taking body makes floor cleaning difficult and becomes an obstacle to foot traffic. Its use by the elderly and some physically impaired individuals is also limited. Due to extensive plumbing changes and its related high cost, foot pedal sink faucet controls are only suitable for institutional use. The impracticality, inconvenience, difficulty of installation and high cost of existing devices necessitates the need for a new device that is practical, responsive, easy to use, easy to install, and low cost.

To work in the consumer market, an automatic faucet control must be a retrofitted appliance, sold as a kit to be installed, which uses the existing plumbing and fixtures, and is responsive to almost every demand that one may expect from a faucet. To accommodate the existing plumbing and accessories such as water filters, ice makers, and auxiliary water heaters, the auto faucet inlet ports must be numerous and strategically placed for all conceivable connecting situations. The low cost, user-friendliness, and ease of installation would play a crucial role in success of such a product. To be practical it should be possible for a consumer to override the automation easily and conveniently. In the case of power failure, the consumer must be able to bypass the system with ease.

SUMMARY OF THE INVENTION

The instant invention fulfills the above stated needs by providing an after market retrofitted faucet control appliance, which is mounted under-the-sink, on the wall and directly under the existing faucet. The invention features two normally closed solenoid valve input ports connected by way of two standard tubes to the water supply valves, hot and cold, and the outputs is then connected to the existing faucet. For the consumer's safety and ease of wiring, the power to operate this system is provided by a low voltage transformer connected to the under sink reciprocal.

The transformer outputs are interrupted by two normally open push button switches, of which one is latchable. The operating switches are then mounted from inside on the door frame of the cabinets, in a manner that the spring action of these switches causes the left and right cabinet doors to extend or jut slightly outward. Should one desire, optional pressure sensitive switch pads will also be available to be installed on the exterior surface of the cabinet doors to act as a switching mechanism to activate the solenoids.

To activate the system, slight knee pressure on the cabinet doors or to door-mounted switch pads causes the switch to close, in turn causing the solenoid valve to open, allowing the water to flow freely through the existing faucet as its flow setting permits. The instantaneous on-off control of water is accomplished by the push button switch normally connected to the right cabinet door. The continuous water flow is accomplished by way of a push button latchable switch connected to the left cabinet door frame. To latch the switch, a light knee pressure is applied to the left cabinet door. In the latch mode, the solenoids remains open indefinitely and the faucet works conventionally, the user can manipulate the water flow manually and conventionally or terminate the flow by applying a second knee pressure to the left cabinet door or by turning the faucet manually to the off position.

It should also be recognized that the switching flexibility of this device also permits the use of numerous alternative commercially available switching apparatuses, such as voice command or lever activated switches. To child proof the system, all that is necessary is to close the sink faucet manually. In this case, if a child exerts pressure on the doors or the switch pads, the solenoids will activate, but the closed sink faucet restricts the flow.

DETAILED DESCRIPTION OF THE PREFERRED EMBODIMENT

Figure 1:
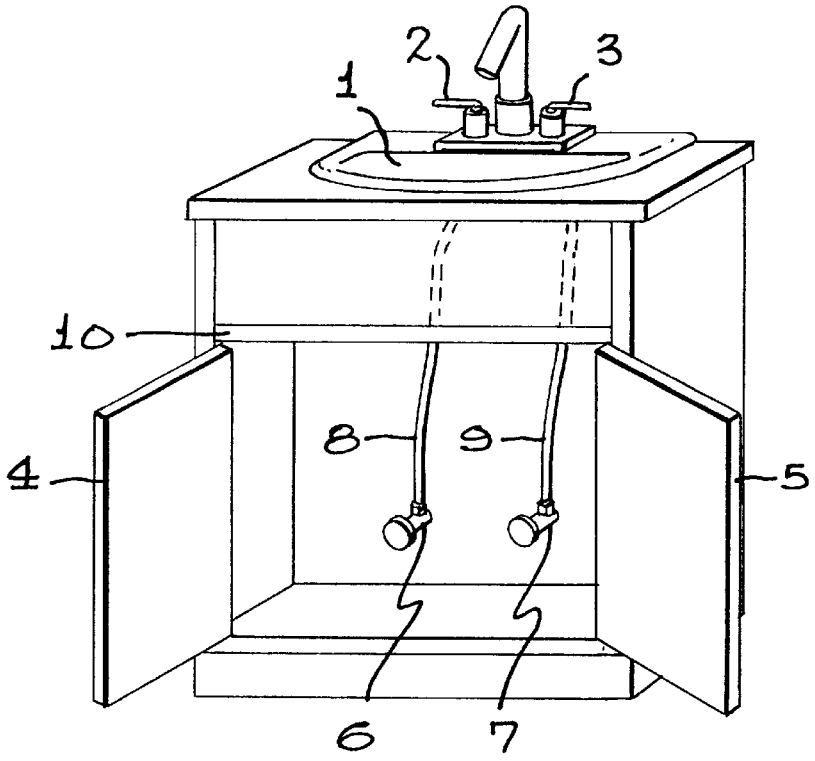
FIG. 1 PRIOR ART
FIG. 1 is a front view of a typical conventional hand-dish washing sink cabinet having the cabinet doors open.

A typical sink cabinet is shown in FIG. 1, having bowl 1, faucet valves 2, 3, under the sink cabinet doors 4, 5, water supply valve gland nuts 6, 7, connecting tubes 8, 9 and upper door frame 10. In FIG. 1, it can be seen that, conventionally, the sink faucet valves 2, 3 are connected by means of tubes 8, 9 to the supply valve gland nuts 6, 7. FIG. 1 also shows the upper door frame 10, to which cabinet doors 4, 5 are rested upon, while closed.

Figure 2:
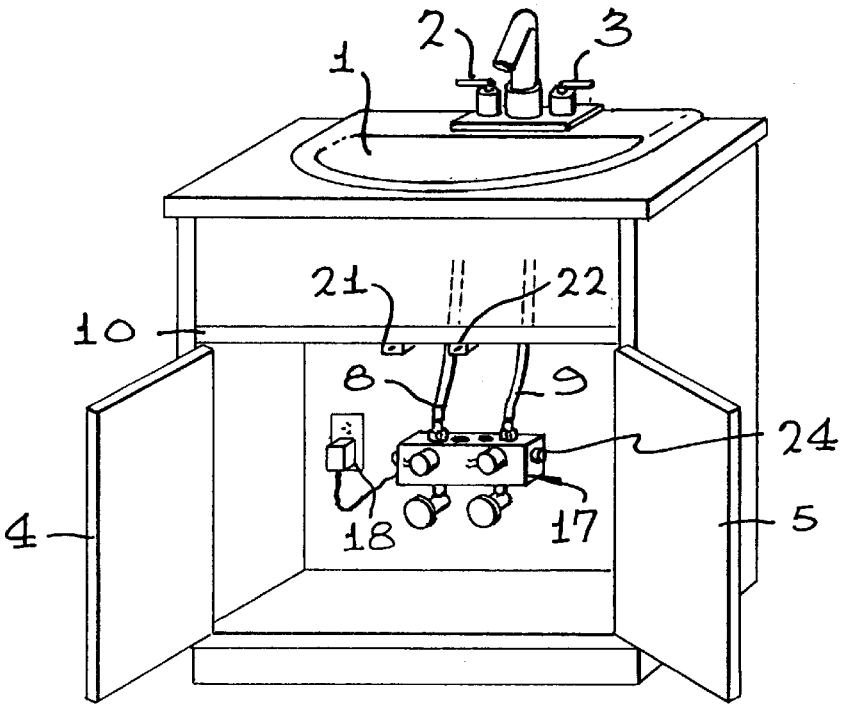
FIG. 2 is a front view of the sink cabinet shown in FIG. 1, which has been retrofit with the automatic faucet control valve system of the present invention.
Figure 3:
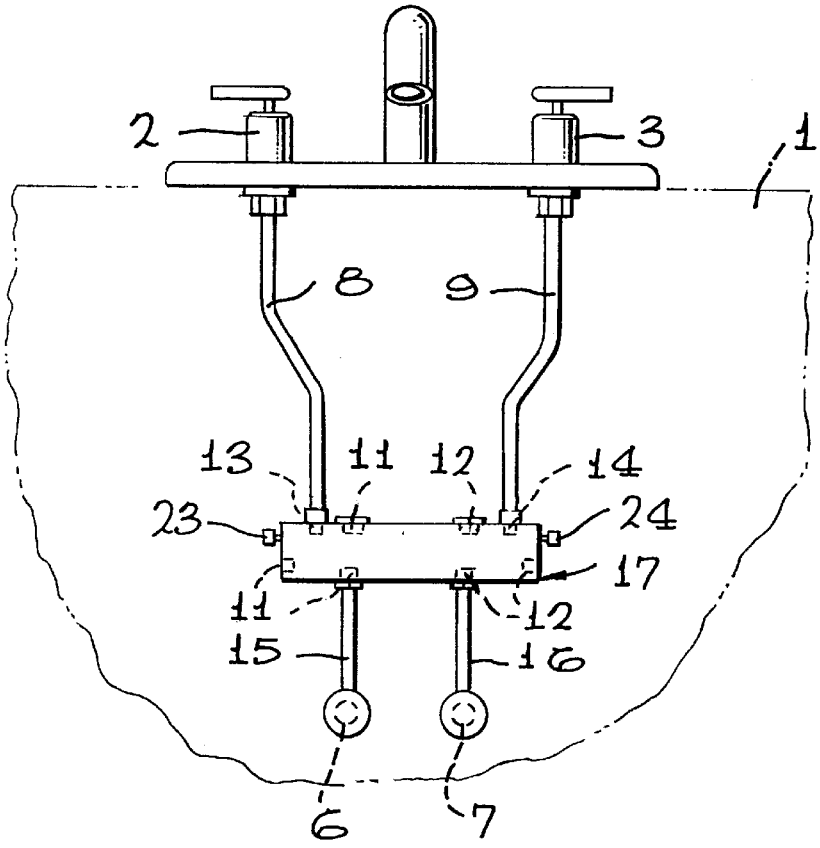
FIG. 3 is a front view, partially broken away, of the retrofitted faucet, showing the automatic faucet control valve in place.

To install the present invention, the gland nuts 6, 7 are first removed. As shown in FIG. 3, the valve body inlet ports 11, 12 are connected through supply tubes 15, 16 to the gland nuts 6, 7. The faucet connecting tubes 8, 9 are then connected to the valve body outlet ports 13, 14 of valve block 17. The controlling switches, which take the form of a latching switch 21 and a momentary switch 22, are then connected to the upper door frame 10 in the manner shown in FIGS. 2 and 4. The switches 21, 22 are connected by means of an electrical wire to solenoid coils 19, 20 on the valve body 17 (see FIGS. 2, 6 and 10).

Figure 10:
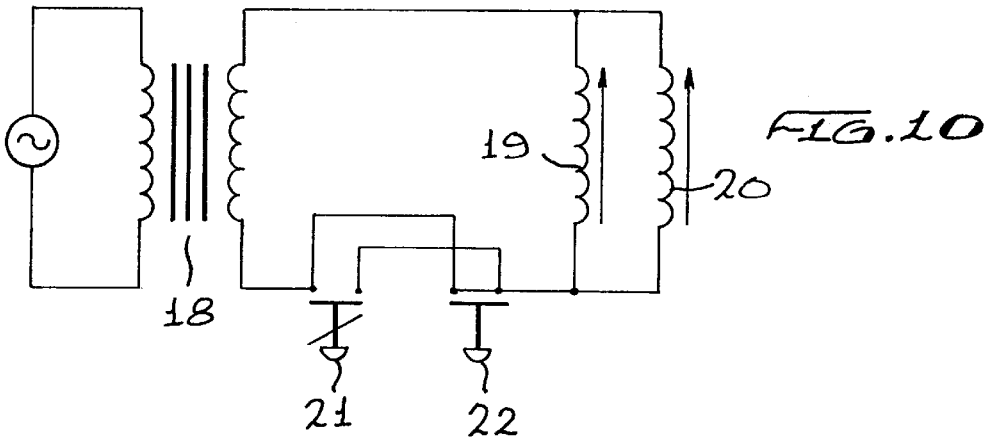
FIG. 10 is an exemplary simplified circuit diagram of the automatic faucet control valve system.

As shown in the exemplary circuit diagram in FIG. 10, the solenoid coils 19', 20' are connected in parallel, and their connection to a low voltage transformer 18 is interrupted so long as the two normally opened push button switches 21, 22 remain open. The solenoid coils 19', 20' are normally closed to water voltage flow unless their coils are energized by the closing action of switches 21, 22. Because the switches 21, 22 are normally open, i.e. in a non-conductive position, they interrupt the connection of the solenoid coils 19, 20 to the low voltage transformer 18, which serves as the power supply, until the switches 21, 22 are closed. As is explained in greater detail below, the positioning of the switches 21, 22 advantageouly allows for a user to accomplish closing of the switches 21, 22, simply by applying gentle pressure with one's knee to the front of one of the cabinet doors 4, 5 mounted under the sink. For consumer safety, transformer 18 is a step down transformer intended to reduce the high wall reciprocal current to a safe handling voltage.

Latching switch 21 is adapted to stay in a closed position when activated (so as to provide a continuous flow of water), thereby continuously maintaining the connection of the solenoid coils 19', 20' to the low voltage transformer 18, until the latchable switch 21 is engaged a second time, which re-opens the switch 21.

Figure 6:
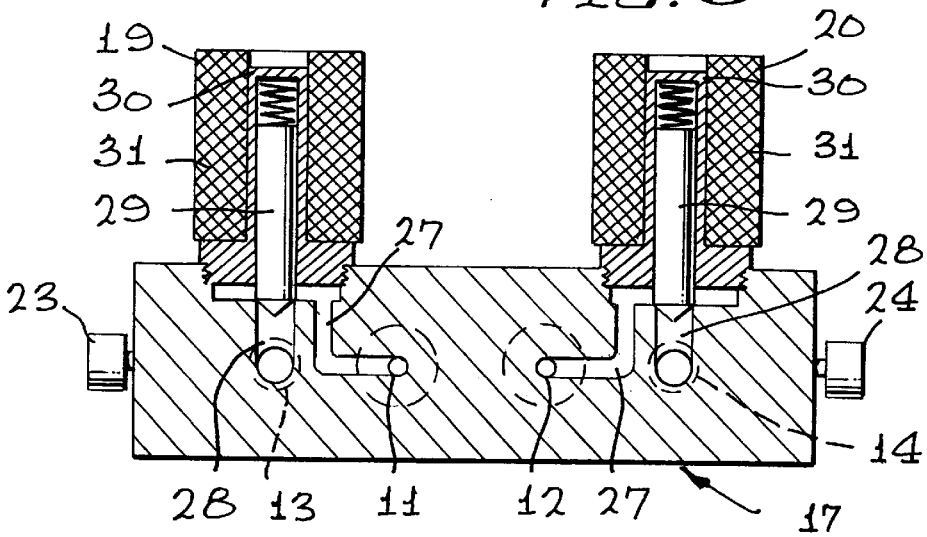
FIG. 6 is a cross-section view taken through lines 6—6 of FIG. 5.
Figure 7:
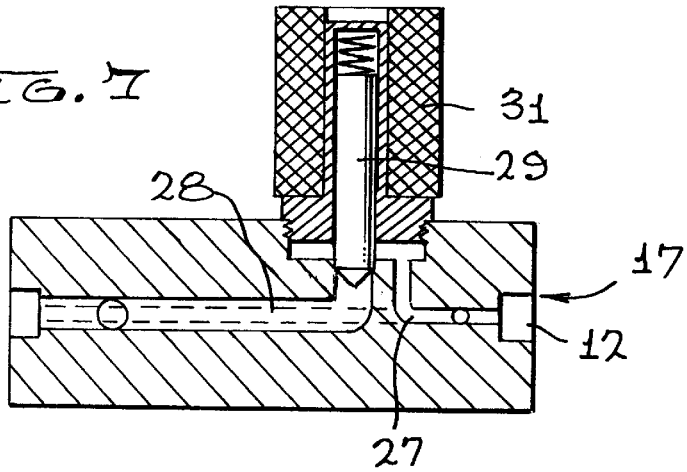
FIG. 7 is a cross-section view taken through lines 7—7 of FIG. 5.

The valve body inlet ports 11, 12 are denied free flow to the valve body outlet ports 13, 14 (see FIG. 8) by the action of needle valves 23, 24 at point 25, 26 and by the inactivated solenoid valves 19, 20 (see FIG. 6). Solenoid valves 19, 20 are typical, normally closed solenoid valves which restrict the water flow through their inlet port 27 and the outlet port 28. Because the internal configuration of a normally closed solenoid valve is not part of the claimed invention, those of ordinary skill in the art will recognize that any suitable configuration for a normally closed solenoid valve may be adopted. However, for purposes of illustration, FIG. 6 shows the function of a basic dual solenoid valve arrangement consisting of spring loaded non-corrosive magnetic plungers 29 and guides 30, electromagnetic coils 31 and valve block with inlet ports 11, 12 and outlet ports 13, 14.

In non-actuated mode, the spring loaded plunger 29 of FIG. 6, aided by water pressure of inlet ports 11, 12, creates a positive seal against the outlet port 28 of the solenoid valves, 19, 20 thus restricting the water flow.

In the activated mode, the energized magnetic coil 31 causes the plunger 29 to move upward, thus removing the obstacle of communication between valve body inlet ports 11, 12 and valve body outlet ports 13, 14 of the solenoid valves 19, 20. In activated mode, the two solenoid valves 19, 20 will simultaneously permit unrestricted water flow through their outlet ports 28, and consequently to the sink faucet, as its settings permit.

Figure 8:
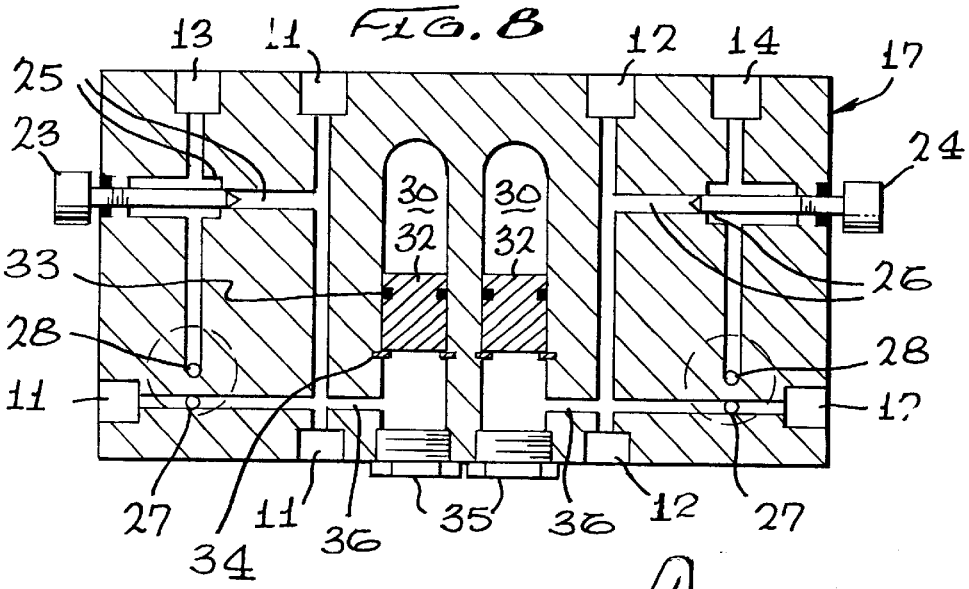
FIG. 8 is a cross-section view taken through lines 8—8 of FIG. 5.

Similarly, the needle valves 23, 24 of FIG. 8 control the manual operation of the invention. In the event of a power failure or malfunction, the needle valves 23, 24, through bores 25, 26 allow free irrigational communication between inlet ports 11, 12 and outlet ports 13, 14 of valve block 17. The needle valve function and the passage ways 25, 26 between inlet ports 11, 12 and the outlet ports 13, 14 can be seen in FIG. 8.

FIG. 8 also shows two cylindrical cavities 30 filled with compressed air and sealed by two pistons 32 containing O-rings 33 as a seal, and retaining rings 34 to retain the pistons 32 within the cylindrical cavities 30. The lower end of each of the two cylindrical cavities, on the uncompressed side of the piston 32, is sealed by threaded plugs 35 and connected by passage ways 36 to water inlets 11, 12. This arrangement will provide a shock absorbing environment to minimize the hammering action and related noises that may be generated by the sudden closing action of the solenoid valves 19, 20. The sudden shock caused by the closing action of the solenoid valves 19, 20 passes through bores 36 and causes the pistons 32 to move against the preset pressurized cavities 30, thus absorbing the shock and hammer effect of sudden closure.

Figure 4:
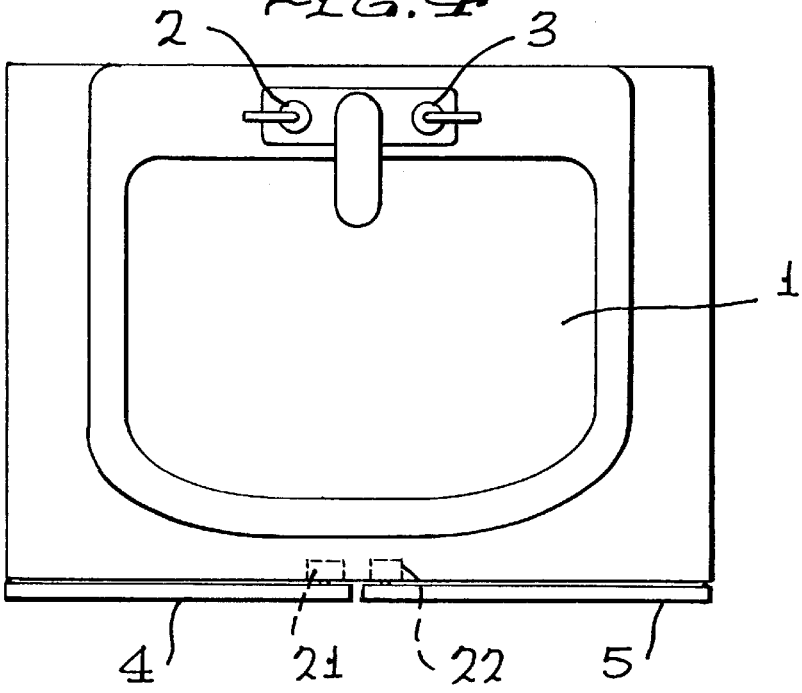
FIG. 4 is a top view of the sink cabinet of FIG. 2 indicating the positions of the controlling switches.
Figure 5:
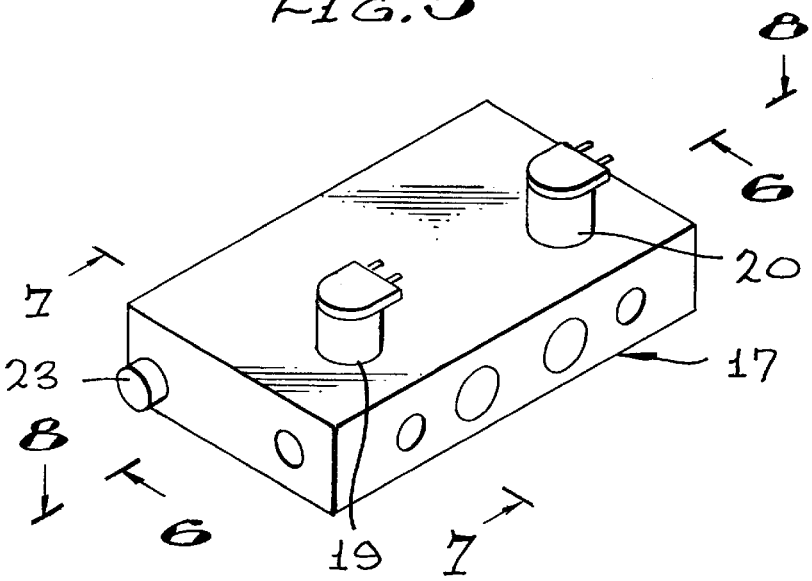
FIG. 5 is a perspective view of the valve block of the automatic faucet control valve system.

As shown in FIG. 4, the switches 21, 22 are provided at the forward end of the cabinet, immediately adjacent the cabinet doors. When the switches 21, 22 are in their open, inactivated position, they cause the associated cabinet door to jut slightly outwardly (FIG. 4). By applying a gentle pressure with one's knee to the cabinet door, the corresponding switch will close.

Figure 9:
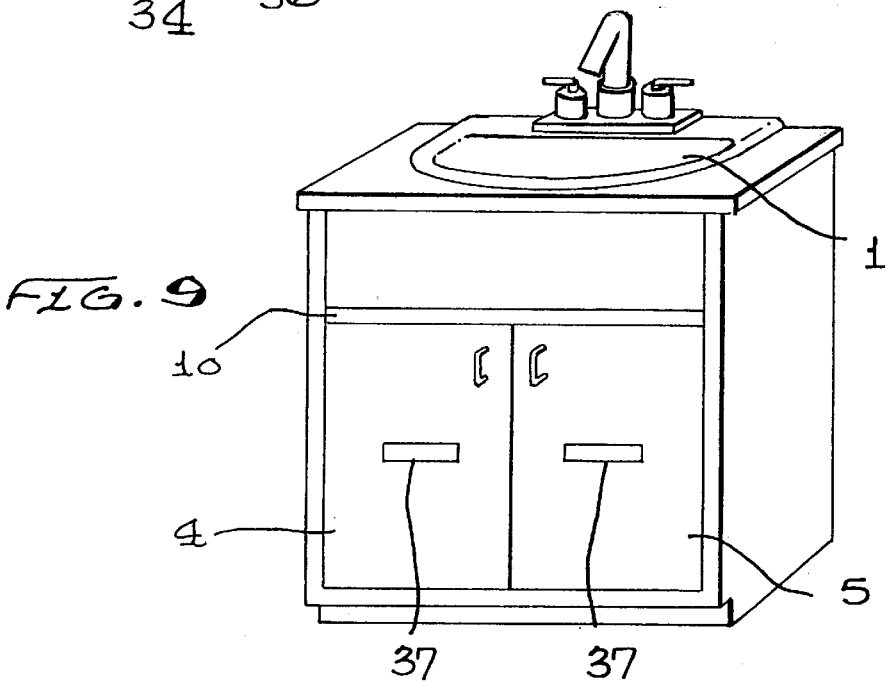
FIG. 9 is a perspective view of the retrofit sink cabinet shown in FIG. 2, having the cabinet doors closed to show mounted switch pads.

As shown in FIG. 9, the switches 21, 22 may instead be activated by pressure sensitive switch pads 37 that can be mounted on the exterior surface of the cabinet doors. This embodiment advantageously immediately makes the user aware that the sink is equipped with a cabinet door faucet valve system.

The illustrated embodiment is exemplary in nature and many of the details thereof could be modified without departing from the spirit and scope of the present invention. For example, the internal configuration of the solenoid valves 19, 20 could be of a different type, such as a piloted solenoid valve. The general shape of the system could also be different. For example, two separate blocks, verses one, each containing a solenoid valve and a diversionary valve. Style-wise, the inlet or outlet ports may be configured differently or the switching apparatus could be of electronic nature. To reduce consumer cost, the shock absorbing portion may be simplified or eliminated.

The essential elements of the invention are a dual solenoid valve with separate inlet-outlet ports and a manually operable diversionary valve, to be operated by two switches mounted on the cabinet frame or door surface and the retrofit nature of the design in which the valve is interposed between the existing faucet and fresh water supply valves.

The arrangement of the present invention makes the automatic valve control system advantageously very easy to install, even by non-plumber consumers. Its simplicity and minimal parts makes it inexpensive, and its practicality and ease of operation will encourage its use. Those of ordinary skill in the art will understand that other changes and modifications can be made to the invention within the scope of the appended claims.

I claim:

1. An automatic control system for a faucet of a sink, comprising:

a valve block adapted to be disposed beneath said sink, inside a cabinet frame having a pair of hinged doors mounted thereon, said valve block having a plurality of supply inlet ports adapted to communicate with hot and cold water supply lines, a plurality of supply outlet ports adapted to communicate with hot and cold water faucet connecting lines for delivering hot and cold water to the faucet of said sink, and a pair of solenoid valves connected in parallel for controlling the flow of water to said supply outlet ports, a first of said solenoid valves adapted to control hot water flow and a second of said solenoid valves adapted to control cold water flow, each of said solenoid valves adapted to electrically communicate with an electrical power supply;

at least one switch adapted to selectively complete the connection between said electrical power supply and said solenoid valves, whereby, upon completion of said connection, said solenoid valves simultaneously open to allow the flow of water to the faucet, said at least one switch including a latching switch that, upon being activated a first time, maintains completion of the connection of said electrical power supply and said solenoid valves until the switch is reactivated;

a second switch in connection with said solenoid valves and said electrical power supply, said second switch being a momentarily non-latching switch and being separated from said latching switch for separate activation;

and each of said doors in communication with a respective one of said switches, whereby either of said switches is activated by applying pressure to an associated one of said doors.

2. An automatic control system for a faucet of a sink, comprising:

a valve block adapted to be disposed beneath said sink, said valve block having a plurality of supply inlet ports adapted to communicate with hot and cold water supply lines, a plurality of supply outlet ports adapted to communicate with hot and cold water faucet connecting lines for delivering hot and cold water to the faucet of said sink, and a pair of solenoid valves connected in parallel for controlling the flow of water to said supply outlet ports, a first of said solenoid valves adapted to control hot water flow and a second of said solenoid valves adapted to control cold water flow, each of said solenoid valves adapted to electrically communicate with an electrical power supply;

at least one switch adapted to selectively complete the connection between said electrical power supply and said solenoid valves, whereby, upon completion of said connection, said solenoid valves simultaneously open to allow the flow of water to the faucet; and said valve block including a manually operable diversionary valve adapted to override said solenoid valves and to control the flow of water to said supply tube outlet ports.

* * * * *